United States Patent [19]

Golan et al.

[11] 4,389,753

[45] Jun. 28, 1983

[54] WEB TAKEOFF ROLL

[75] Inventors: Michael G. Golan, Amston, Conn.; Leo Desrosiers, Woonsocket, R.I.

[73] Assignee: The Kendall Company, Walpole, Mass.

[21] Appl. No.: 308,431

[22] Filed: Oct. 5, 1981

[51] Int. Cl.[3] ..... D01G 15/46

[52] U.S. Cl. ..... 19/106 R

[58] Field of Search ..... 19/106 R, 98, 99, 65 CR

[56] References Cited

U.S. PATENT DOCUMENTS

| | | | |
|---|---|---|---|
| 46,120 | 1/1865 | Lord et al. | 19/106 R |
| 372,771 | 11/1887 | Senior et al. | 19/106 R |
| 3,283,366 | 11/1966 | Kalwaites | 19/106 R |
| 3,370,326 | 2/1968 | Law | 19/106 R |
| 4,274,178 | 6/1981 | Hotta | 19/106 R |

FOREIGN PATENT DOCUMENTS

| | | | |
|---|---|---|---|
| 941843 | 11/1963 | United Kingdom | 19/106 R |
| 1140762 | 1/1969 | United Kingdom | 19/106 R |

*Primary Examiner*—Louis Rimrodt

[57] ABSTRACT

Carding cylinder takeoff apparatus for producing a randomized web of textile fibers comprises a doffing roll, a wire covered transfer roll closely spaced from the doffing roll surface and a rotatable takeoff roll having a resilient rubber surface with a Shore A Durometer hardness of less than about 80 closely spaced from the transfer roll. The transfer roll is rotated in the same surface direction and at a surface speed less than that of the doffing roll for transferring the fibrous web and forming fiber hooks in the web to randomize it. The takeoff roll is rotated in the opposite surface direction and at a surface speed greater than that of the transfer roll for removing the randomized web from the transfer roll.

3 Claims, 3 Drawing Figures

FIG 1
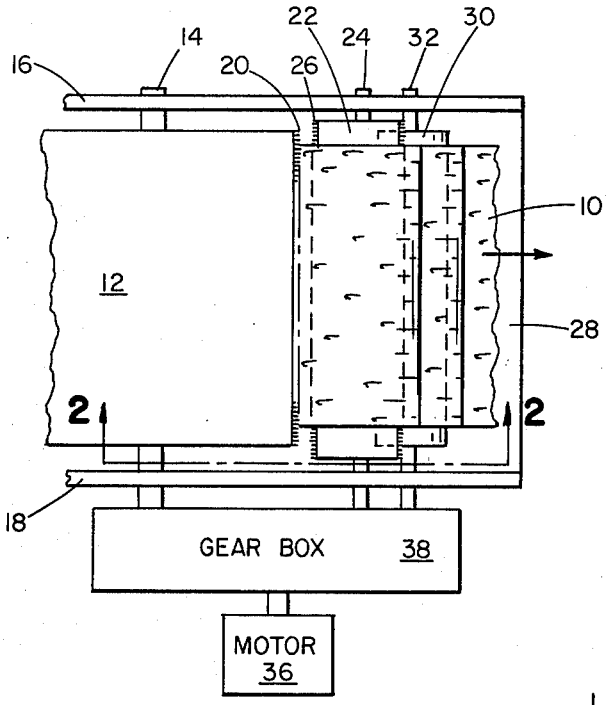
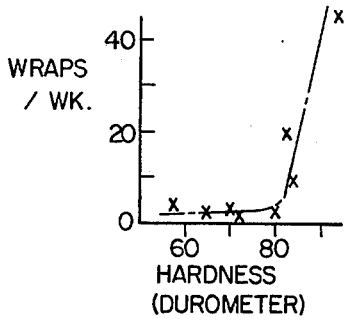
FIG 3
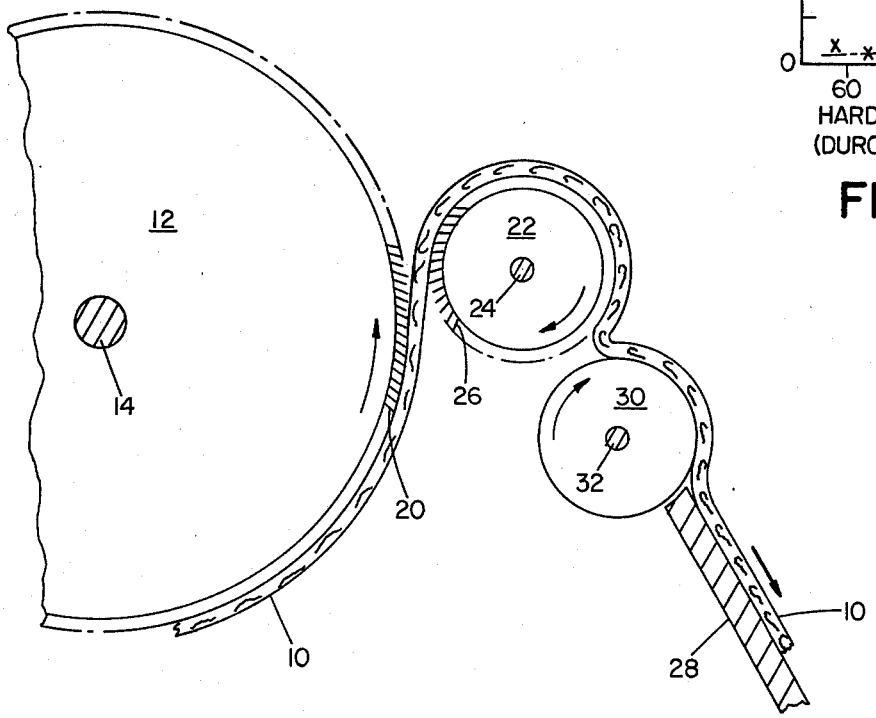
FIG 2

WEB TAKEOFF ROLL

This invention relates to textile carding cylinder takeoff apparatus for producing a randomized web of textile fibers.

Conventional carding cylinder takeoff apparatus of the type which is intended to produce a randomized web utilizes a wire covered transfer roll rotating at a surface speed less than that of the doffing roll for removing the fibrous web from the doffing roll and randomizing it. The randomized web is then removed from the transfer roll by a knife blade used in combination with a fluted metal takeoff roll rotating in the opposite surface direction from the transfer roll. However, this combination of knife blade and fluted metal roll has proved to be deficient in operation, since it proved to be necessary to readjust the apparatus whenever the type of fiber to be processed was changed.

Accordingly, it is a major object of the present invention to provide novel carding cylinder takeoff apparatus which greatly reduces the readjustment necessary to accommodate fiber changes and so provides improved operation.

Accordingly, the present invention provides carding cylinder takeoff apparatus for producing a randomized web of textile fibers and comprises a doffing roll, a transfer roll having a wire-covered surface closely spaced from the doffing roll surface and a novel rotatable takeoff roll, closely spaced from the transfer roll surface, having a resilient rubber surface with a Shore A Durometer hardness of less than about 80 and preferably of about 50 to 80.

The transfer roll is rotated in the same surface direction and at a surface speed less than that of the doffing roll surface for transferring the fibrous web from the doffing roll to the transfer roll to form fiber hooks in the web to randomize the web. The takeoff roll is rotated in the opposite surface direction and at a surface speed greater than that of the transfer roll for removing the randomized web from the transfer roll.

For the purpose of fully explaining the above and further objects and features of the invention, reference is now made to the following detailed description of a preferred embodiment thereof, together with the drawings, wherein:

FIG. 1 is a top view of carding cylinder takeoff apparatus embodying the present invention;

FIG. 2 is a side sectional view of the apparatus of FIG. 1, taken on line 2—2 thereof; and FIG. 3 is a graphical showing of tests of the apparatus of the invention.

Referring to the drawings, there is shown a conventional doffing roll 12 having its shaft 14 mounted in suitable bearings for rotation, in the direction shown by the arrow in FIG. 1, on the side frame members 16 and 18 of a standard textile card having a carding cylinder, not shown. Doffing roll 12 may be of a width of about 42 inches and a diameter of about 30 inches and has its cylindrical surface covered with metallic wire card clothing, such as Ashworth PA50, having its wires 20 oriented in the trailing direction, as shown in FIG. 1, for carrying thereon the carded staple fibers of web 10.

Transfer roll 22 also has its shaft 24 mounted in suitable bearings for rotation, in the direction shown by the arrow in FIG. 1, on the side frame members 16 and 18. Transfer roll 22 may be of a width of about 42 inches and a diameter of about 5 inches and also has its cylindrical surface covered with metallic wire card clothing, such as Hollingsworth 076200 864, having its wires 26 oriented in the trailing direction, as shown in FIG. 1, for carrying thereon the web 10 transferred from doffing roll 12. Transfer roll 22 is set relatively to doffing roll 12 to provide a closely spaced clearance of 0.015 inches between the ends of their wires 20 and 26. For removing the web 10 from transfer roll 22 and depositing it on output chute 28, there is provided takeoff roll 30, which also has its shaft 32 mounted in suitable bearings for rotation, in the direction shown by the arrow in FIG. 1, on the side frame members 16 and 18. Takeoff roll 30 may also be of a width of about 42 inches and a diameter of about 5 inches.

A suitable motor 36 and gearbox 38 is provided for driving the shafts 14, 24 and 32 at their desired speeds; alternatively they may be driven from the main card cylinder drive, not shown.

More specifically, in operation, doffer roll 12 is rotated at a surface speed of about 300 feet/minute. Transfer roll 22 is rotated in the same surface direction and at a surface speed of about 150 feet/minute, substantially less than, preferably about half, that of doffing roll 12 for transferring fibrous web 10 to transfer roll 22 to form fiber hooks in web 10 to randomize the web. Takeoff roll 30 is rotated in the opposite surface direction and at a surface speed of about 170 feet/minute, greater than that of transfer roll 22 for removing the randomized web 10 from wires 26 of transfer roll 22 and depositing it onto chute 28.

According to the present invention, we have discovered that the necessity of readjustment to accommodate fiber changes is greatly reduced if the cylindrical surface of takeoff roll 30 is of smooth rubber with a Shore A Durometer hardness of less than 80 and preferably between about 50 to 80, with a setting relatively to transfer roll 22 to provide a closely spaced clearance of about 0.025 inches between the ends of transfer roll wires 26 and the surface of takeoff roll 30.

Insofar as the problem of fiber wrap-up is concerned, a series of tests, the results of which are graphically shown in FIG. 3, were run with 1½ denier, 1½ inch polyester staple fiber, using takeoff rolls having Shore A Durometer hardness values of 50 to 90, in order to determine the relationship between rubber hardness and the wrap-up frequency. As may be seen from the graph of FIG. 3, in which each of the eight test values is indicated by an "x", the number of wrap-ups using hardness values of 50 to 80 was acceptably low, less than 5 per week. At hardness values over 80, the number of wrap-ups per week increased dramatically to unacceptable values of 20 or greater.

Various modifications within the spirit of the invention and the scope of the appended claims will be apparent to those skilled in the art.

What is claimed is:

1. Carding cylinder takeoff apparatus for producing a randomized web of textile fibers, comprising a rotatable doffing roll having a wire-covered surface for carrying thereon a fibrous web a rotatable transfer roll having a wire-covered surface closely spaced from said doffing roll surface for transferring said fibrous web from said rotatable doffing roll surface to said transfer roll surface to form fiber hooks in said web during said transferring to randomize said web, and a rotatable takeoff roll closely spaced from said transfer roll surface and having a resilient rubber surface with a Shore A Durometer hardness of less than about 80 for removing said randomized web from said transfer roll.

2. Carding cylinder takeoff apparatus for producing a randomized web of textile fibers, comprising a rotatable doffing roll having a wire-covered surface for carrying thereon a fibrous web doffing roll power means for rotating said doffing roll a rotatable transfer roll having a wire-covered surface closely spaced from said doffing roll surface transfer roll power means for rotating said transfer roll surface in the same surface direction and at a surface speed less than that of said doffing roll surface for transferring said fibrous web from said rotatable doffing roll surface to said transfer roll surface to form fiber hooks in said web during said transferring to randomize said web a rotatable takeoff roll closely spaced from said transfer roll surface and having a resilient rubber surface with a Shore A Durometer hardness of less than about 80, and takeoff roll power means for rotating said takeoff roll in the opposite surface direction and at a surface speed greater than that of said transfer roll surface for removing said randomized web from said transfer roll.

3. Carding cylinder takeoff apparatus as claimed in claim 1 or 2, wherein said takeoff roll has a resilient rubber surface with a Shore A Durometer hardness of between about 50 to 80.

* * * * *